US007669902B2

(12) United States Patent
Orbeta

(10) Patent No.: US 7,669,902 B2
(45) Date of Patent: Mar. 2, 2010

(54) ELECTRIC STRIKE HORIZONTAL ADJUSTMENT

(75) Inventor: Ferdinand E. Orbeta, Mount Kisco, NY (US)

(73) Assignee: Trine Access Technology, Inc., Bronx, NY (US)

( * ) Notice: Subject to any disclaimer, the term of this patent is extended or adjusted under 35 U.S.C. 154(b) by 151 days.

(21) Appl. No.: 12/020,734

(22) Filed: Jan. 28, 2008

(65) Prior Publication Data

US 2009/0188289 A1 Jul. 30, 2009

(51) Int. Cl.
*E05B 15/02* (2006.01)
*E05B 15/00* (2006.01)

(52) U.S. Cl. ..... 292/340; 292/341.18; 292/341.19; 292/DIG. 60

(58) Field of Classification Search ..... 292/340, 292/341, 341.18, 341.19, DIG. 60
See application file for complete search history.

(56) References Cited

U.S. PATENT DOCUMENTS

| | | | | |
|---|---|---|---|---|
| 1,059,530 | A * | 4/1913 | Dupuis | 292/341.19 |
| 1,272,115 | A * | 7/1918 | Russell | 292/341.19 |
| 2,403,182 | A * | 7/1946 | Leary et al. | 292/341.19 |
| 2,643,149 | A * | 6/1953 | Mager | 292/341.18 |
| 2,781,219 | A * | 2/1957 | Bahorik | 292/341.18 |
| 2,790,667 | A * | 4/1957 | Schoepe | 292/341.18 |
| 3,006,677 | A * | 10/1961 | Royalty | 292/341.18 |
| 4,183,568 | A * | 1/1980 | Ferracane | 292/341.18 |
| 4,492,397 | A * | 1/1985 | Allenbaugh | 292/341.18 |
| 5,219,196 | A | 6/1993 | Luker | |
| 5,490,699 | A | 2/1996 | Uyeda | |
| 5,988,711 | A | 11/1999 | Toma | |
| 6,595,563 | B2 | 7/2003 | Kiernan | |
| 6,634,685 | B2 | 10/2003 | Herron et al. | |
| 6,935,663 | B2 | 8/2005 | Schildwachter et al. | |
| 6,945,573 | B2 | 9/2005 | Ruiz et al. | |
| 7,144,053 | B2 | 12/2006 | Bashford | |
| 7,185,926 | B2 | 3/2007 | Helsley et al. | |
| 7,240,931 | B1 | 7/2007 | Casey | |
| 7,571,941 | B2 * | 8/2009 | Chang | 292/347 |
| 2006/0157991 | A1 * | 7/2006 | Nguyen | 292/341.18 |
| 2006/0192397 | A1 | 8/2006 | Schnarr et al. | |
| 2007/0145753 | A1 | 6/2007 | Stein | |

FOREIGN PATENT DOCUMENTS

JP 01223276 A * 9/1989

* cited by examiner

*Primary Examiner*—Carlos Lugo
(74) *Attorney, Agent, or Firm*—Norris McLaughlin & Marcus

(57) ABSTRACT

An electrically-operable strike for locking and unlocking doors. The strike is mounted on a face plate which in turn is mounted on a door jamb. The face plate is provided with mounting apertures which receive adjustment inserts each having an offset aperture for a mounting screw for mounting the strike on the face plate. The face plate also has a tongue extending distally from a lip and a break-off portion at the distal end of the tongue. The strike is first mounted with the offset apertures in a distal position. If the strike does not function properly due to preload, the strike is remounted with the offset apertures in a proximal position and the break-off portion is removed.

2 Claims, 5 Drawing Sheets

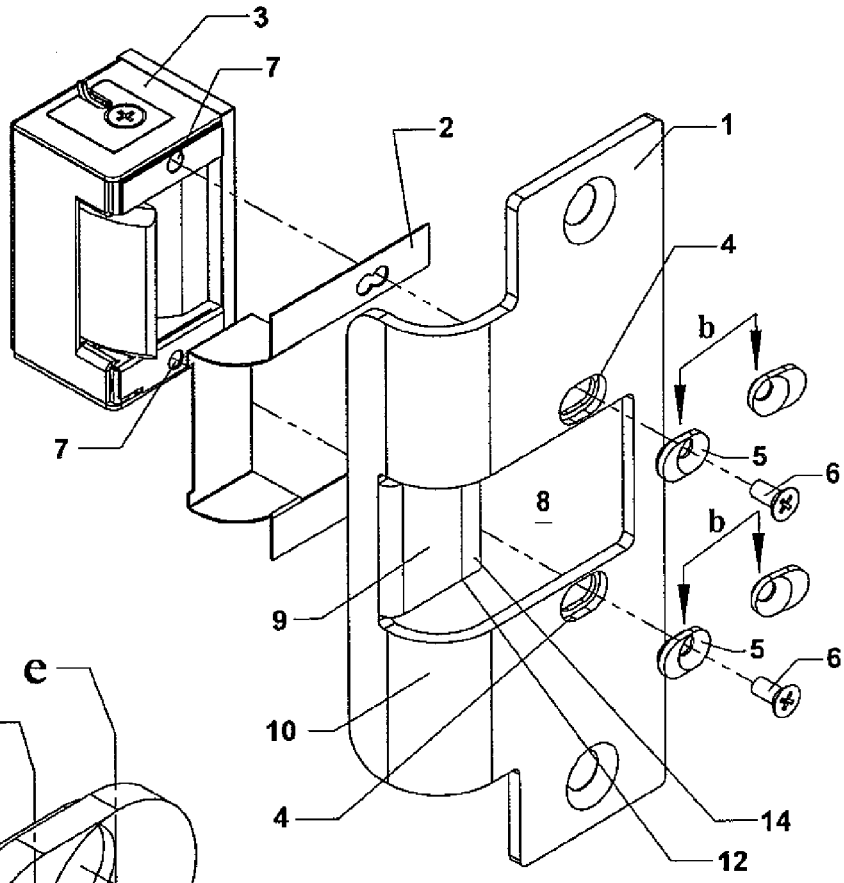
FIG. I
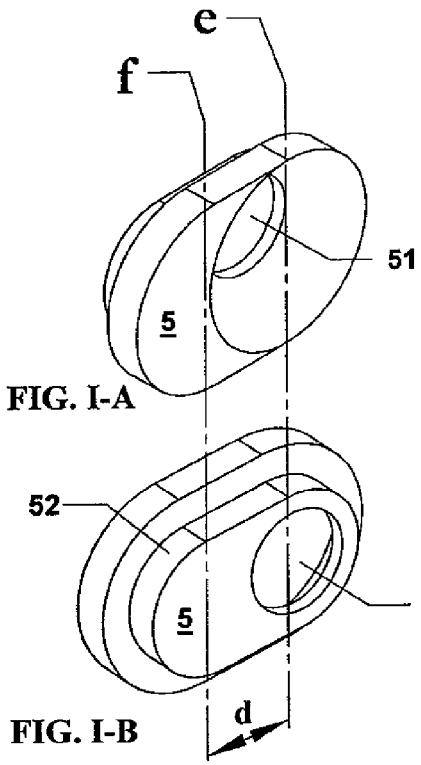
FIG. I-A
FIG. I-B

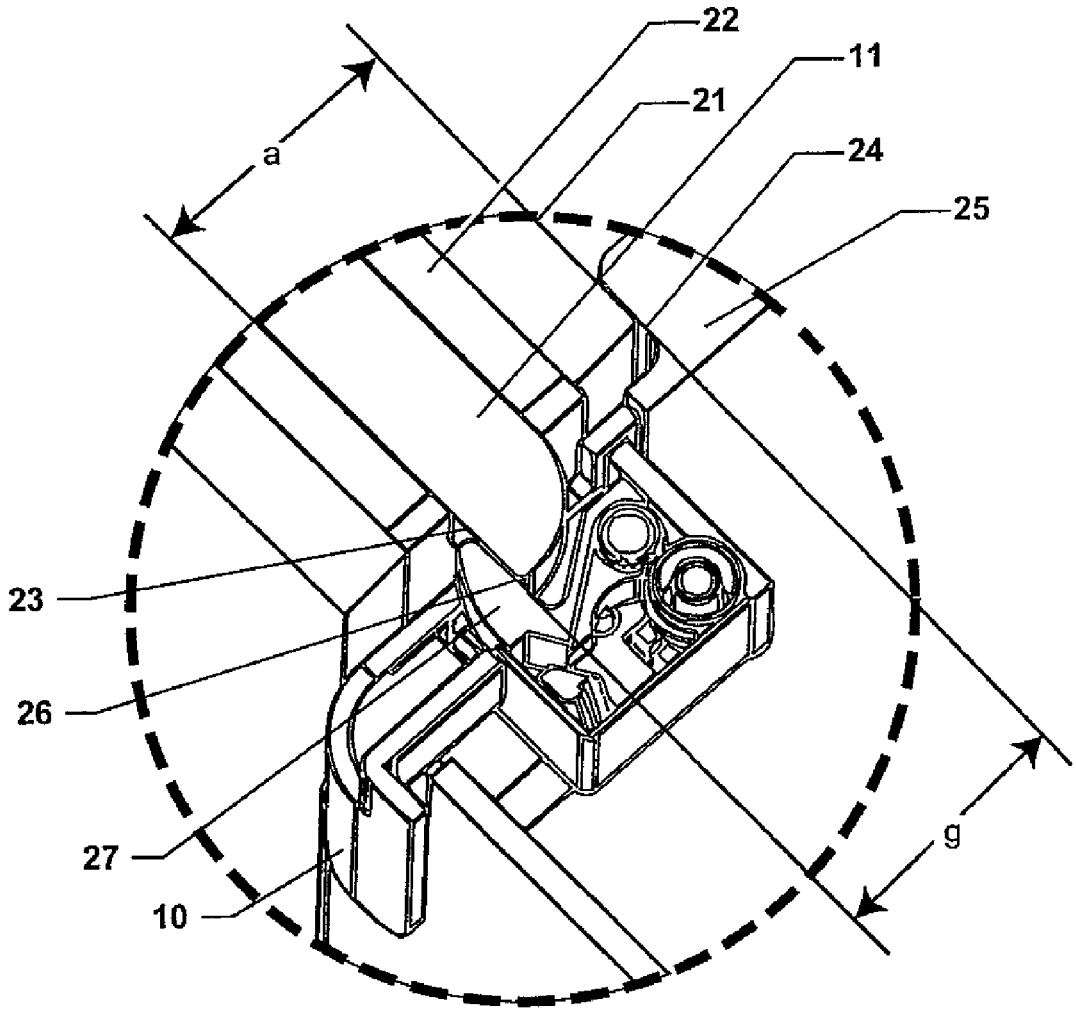
FIG. II

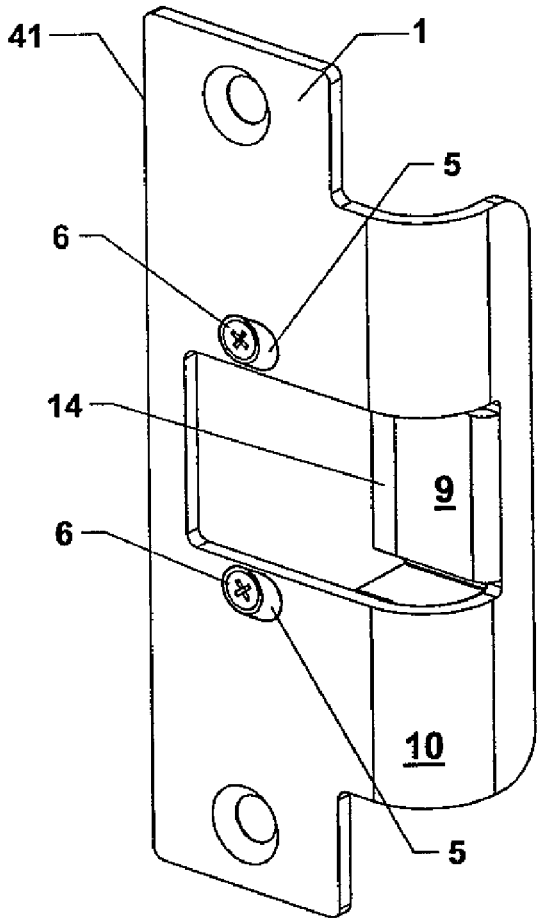
FIG. III-A
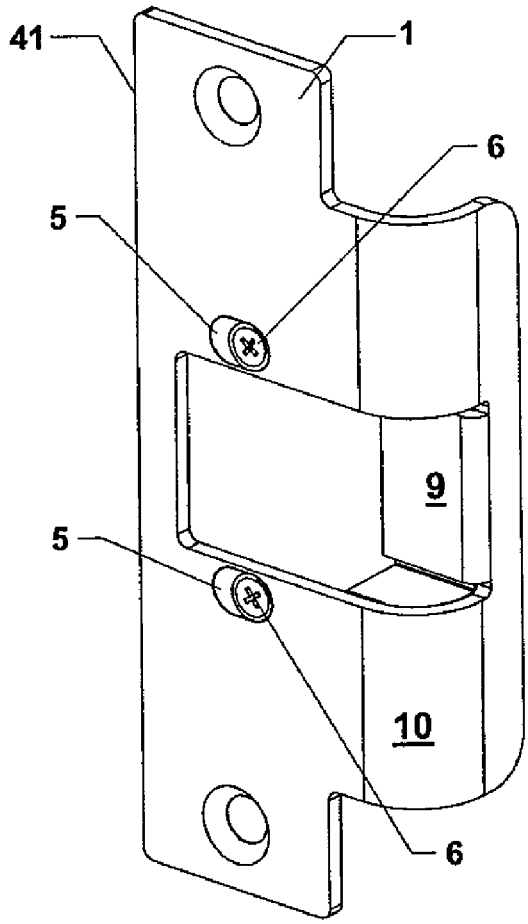
FIG. III-B

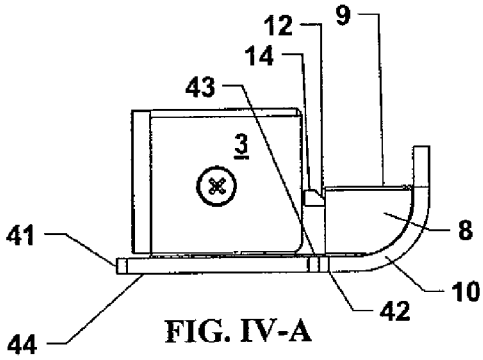
FIG. IV-A
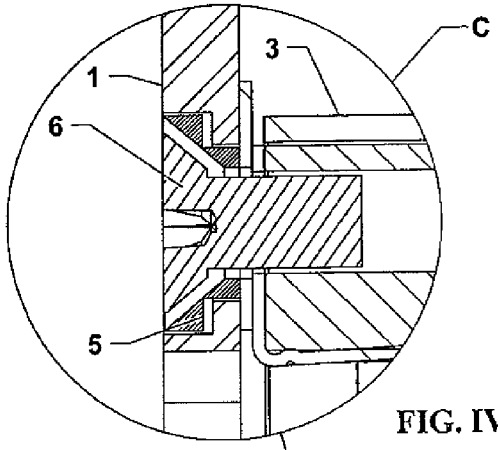
FIG. IV-D
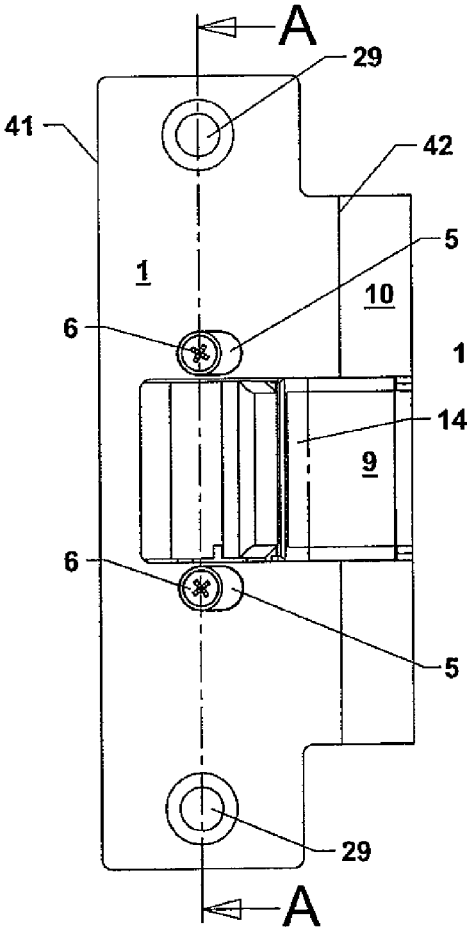
FIG. IV
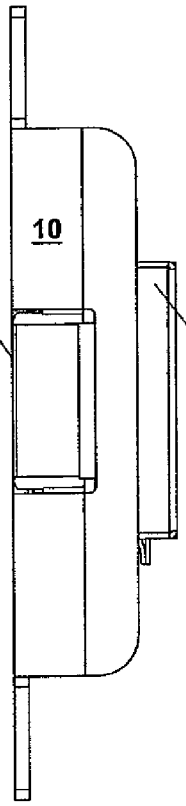
FIG. IV-B
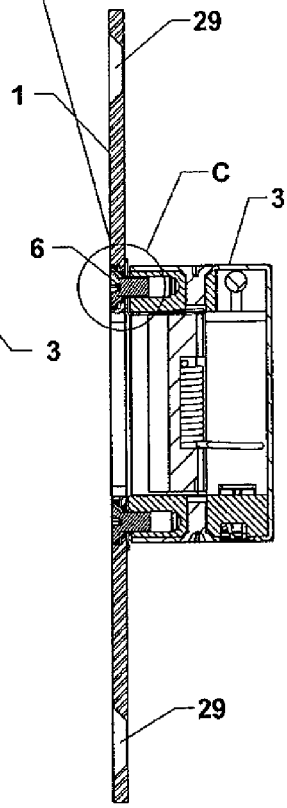
FIG. IV-C

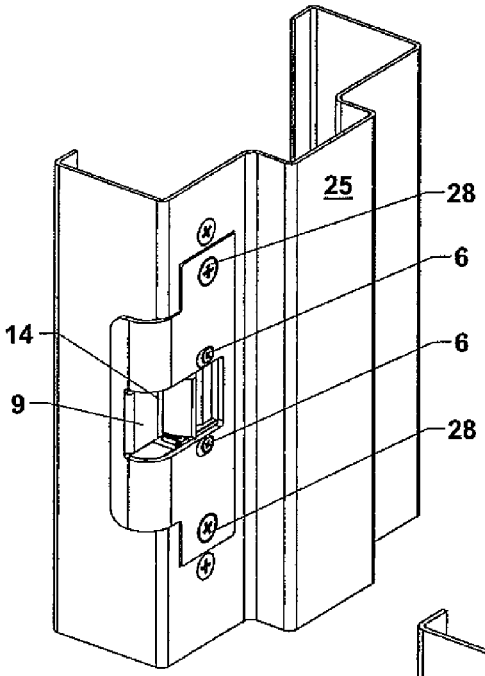
FIG. V
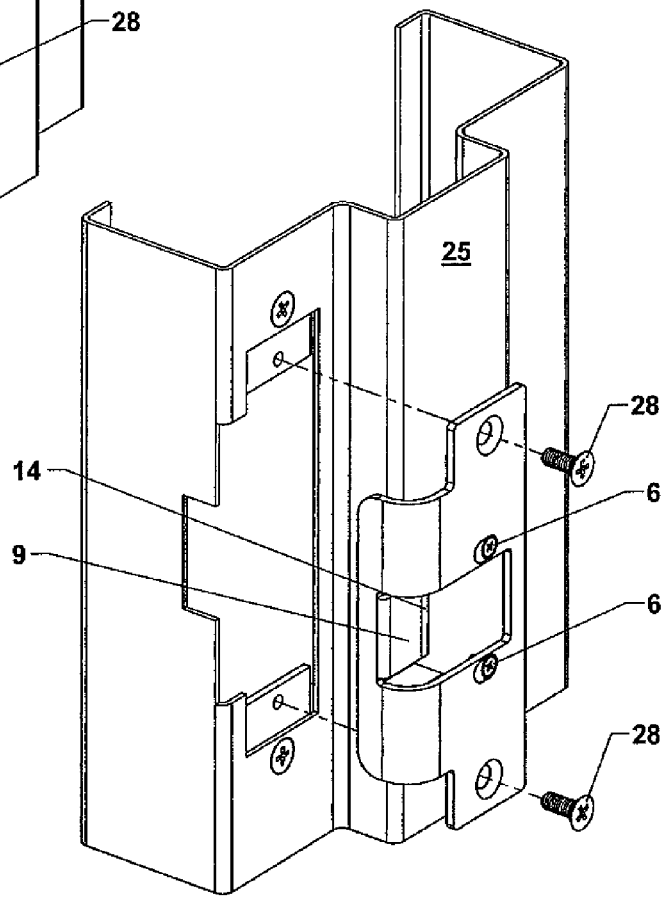
FIG. VI

ELECTRIC STRIKE HORIZONTAL ADJUSTMENT

BACKGROUND OF THE INVENTION

1. Field of the Invention

The present invention has to do with electrically-operable strikes for locking and unlocking doors and particularly relates to apparatus and methods for horizontal adjustment of an electric strike housing within a door jamb in order to overcome preload conditions that prevent the strike from unlocking.

2. The Related Art

In most installations, when an electrically-operable strike does not release the door the problem stems from preload. Preload is a condition where the bolt of the door lock exerts pressure on the latch of the electric strike thereby preventing the mechanism from unlocking. A simple way of testing for preload is to leave the door open and check to see if the electric strike works properly by applying power to the strike (for fail-secure) or switching the power off (for fail-safe). If the strike works with the door open, the next step is to measure the position of the bolt compared with the mating surface of the latch on the strike. If the installation is too tight it may be causing a preload condition wherein the bolt applies pressure to the latch of the strike thereby pinching the locking mechanism and preventing the strike from operating properly. Preload may be caused by warping of the door, settlement of the structure around the frame, improper installation or any other conditions causing misalignment of the bolt and strike latch.

Solutions to the problem of pre-load have been disclosed in the prior art but they tend to be complex and expensive or unreliable.

U.S. Pat. No. 7,144,053 describes an electric strike assembly wherein the lip bracket can be moved relative to the housing by providing slots in the lip bracket and cooperating sawtooth elements in the housing and lip bracket. With the screws in a loosened condition the lip bracket is moved to a desired position and then the screws are tightened. The sawtooth elements then mesh together upon tightening the screws to prevent relative movement of the housing and lip bracket.

A positionable door strike is described in U.S. Pat. No. 7,240,931. A strike plate and a base plate are provided wherein the strike plate can travel relative to the base plate and the strike plate is ultimately held in its desired position with set screws.

The present invention provides an inexpensive and reliable solution to the problem created by preload conditions. And the horizontal location of the strike housing of the invention is easily adjusted using a screwdriver and pliers.

The terms "electric strike" and "strike" as used herein refer to an electrically-operable strike.

SUMMARY OF THE INVENTION

According to the invention, a new face plate is provided with features and elements which permit the horizontal adjustment of a strike housing within the door jamb after installation of the strike. Mounting apertures are provided in the face plate for mounting the strike housing to the inner surface of the face plate. The inner surface abuts the door jamb and the strike housing is installed within the door jamb. The mounting apertures are shaped and sized to receive adjustment inserts and each insert has an offset aperture for a mounting screw. The adjustment inserts can each be placed into a mounting aperture in two positions. In a first position the offset aperture is disposed toward a distal side of the face plate and in a second position the offset aperture is disposed toward a proximal side of the face plate.

The face plate has a substantially flat portion which is affixed to the door jamb usually by screws but welding or other means of fastening can be used for this purpose as known to those skilled in the art. A convex lip extends from a proximal line or segment of the flat portion (i.e., the terminus where the flat portion ends and the face plate begins to curve to form the convex lip) and overlaps an edge of the door jamb when the face plate is installed. A channel extends from the lip toward the distal edge of the flat portion, and a recessed tongue extends from the lip in the same direction as the channel and in parallel with the flat portion. The channel and tongue together act as a guide for a bolt of a door lock. The tongue has a length and a distal end. A snap-off portion of the tongue is provided near the distal end of the tongue. When the snap-off portion is removed the length of the tongue is shortened.

BRIEF DESCRIPTION OF THE DRAWINGS

FIG. I is an exploded perspective view of the face plate elements and the strike housing of the invention.

FIG. I-A and I-B are front and rear perspective views of an adjustment insert 5.

FIG. II is a perspective section view illustrating the face plate and strike housing installed in a door jamb.

FIGS. III-A and III-B are perspective elevation views of the electric strike of the invention wherein FIG. III-A illustrates the position of the strike before preload is corrected and FIG. III-B illustrates the position after preload has been corrected.

FIG. IV is a front elevation view of the face plate and strike of the invention.

FIG. IV-A is a top view of FIG. IV.

FIG. IV-B is a side elevation view of FIG. IV looking toward the right side of FIG. IV.

FIG. IV-C is a section view of FIG. IV taken along section line A-A.

FIG. IV-D is a magnified view of the area within circle c of FIG. IV-C.

FIG. V illustrates in perspective the face plate and strike of the invention installed in a door jamb.

FIG. VI is an exploded perspective view of the face plate and strike of the invention.

DESCRIPTION OF THE PREFERRED EMBODIMENT

FIG. I is an exploded perspective view illustrating face plate 1, dust cover 2 and strike housing 3. Mounting apertures 4 are shaped and sized to receive adjustment inserts 5. Mounting screws 6 mount the housing 3 and guide plate 2 by screwing them into threaded apertures 7. Channel 8 and tongue 9 extending distally from convex lip 10 serve as a guide for bolt 11. (See FIG. II.) Tongue 9 is scored at score 12 to provide break-off portion 14. The location of score 12 is indicated in FIG. I by a line on the outer side of tongue 9. FIG. IV-A illustrates the score 12 itself as a deep score or groove on the inner side of tongue 9.

FIGS. 1-A and I-B illustrate in detail an embodiment of adjustment insert 5. FIG I-A is a front perspective view illustrating offset aperture 51 for a mounting screw 6. FIG. 1-B is a rear perspective view also illustrating offset aperture 51. An extension 52 can be provided on the rear side of adjustment insert 5 to insure a secure mechanical fit into mounting aperture 4. Broken line e passes through the center of offset aperture 51. The distance d from broken line e to broken line f represents the horizontal adjustment distance achieved by rotating adjustment aperture 5 in the direction of arrows b in FIG. I. The distance d is also the same as or approximately the same as the width of break-off portion 14, the width being the distance from score 12 to the distal end of tongue 9. Thus, when the adjustment inserts 5 are rotated in the direction b and the break-off portion 14 is removed from the tongue, the length of the tongue is reduced by the distance d and the preload condition is corrected. In most cases, a distance d of about ⅛ inch will be sufficient to eliminate preload.

The mounting apertures are shaped and sized to receive from the outer surface of the face plate the adjustment inserts in either position. In other words, each adjustment insert will fit securely in a mounting aperture whether the offset aperture 51 is in a distal position or a proximal position.

FIG. II is a perspective section view of an electric strike of the invention installed in a door jamb. When a strike works properly with the door open but not with the door closed, two measurements can be taken to determine whether or not the problem is caused by preload. The distance a from side 21 of door 22 to the flat side 23 of bolt 11 is measured. The distance g from the stop 24 of door jamb 25 to the flat side 26 of the strike latch 27 is also measured. The distance g should be slightly greater than the distance a, preferably about 1/16 inch. This would provide a 1/16 inch gap between the flat side 23 of bolt 11 and flat side 26 of strike latch 27. If there is no gap, the bolt will exert pressure on the latch causing preload and the strike may not function properly.

FIG. III-A is a perspective view of the face plate and strike of the invention before preload is corrected and FIG. III-B is a perspective view of the face plate and strike of the invention after preload has been corrected. In FIG. III-A, adjustment insert 5 is positioned so that mounting screws 6 are on the left hand (distal) side, closest to the distal edge 41 of the flat portion of face plate 1. Break-off portion 14 has not been removed from tongue 9. In FIG. III-B, adjustment insert 5 is positioned so that mounting screws 6 are on the right hand (proximal) side, closest to convex lip 10 and break-off portion 14 has been removed.

FIG. IV to IV-D are provided to illustrate the invention in more detail. FIG. IV is a front elevation view of the face plate 1 with a strike housing 3 installed thereon. A flat portion of the face plate 1 is the portion disposed between distal edge 41 and the proximal terminus illustrated by line 42. Installation apertures 29 are provided for installing the face plate in a door jamb. FIG. IV-A is a top view of FIG. IV and FIG. IV-B is a side view of FIG. IV looking toward the right side of FIG. IV. In FIG. IV-A, the channel 8 extends from lip 10 toward distal edge 41 and tongue 9 also extends distally from lip 10 and in parallel with inner surface 43 of the flat portion and recessed away from the flat portion. The outer surface of the flat portion is designated by reference numeral 44. FIG. IV-C is a section view taken along section line A-A of FIG. IV and illustrating face plate 1 and strike housing 3 in section. The portion of FIG. IV-C encircled by circle c is magnified and illustrated in FIG. IV-D. Portions of face plate 1 and strike housing 3 are illustrated in section in FIG. IV-D and adjustment insert 6 and mounting screw 6 are also illustrated in section.

FIG. V illustrates the face plate and strike of the invention mounted in door jamb 25 with face plate screws 28. FIG. VI is an exploded view of FIG. V.

What is claimed is:

1. A striker assembly for mounting an electrically-operable door strike in a door jamb, the assembly comprising:

a strike housing comprising an electrically-operable door strike, and a face plate having:

a substantially flat portion, having an inner surface and an outer surface, a convex lip extending from a proximal terminus of the flat portion downwardly from the outer surface, a channel extending from the lip toward a distal edge of the flat portion, a tongue extending from the lip distally along the channel in parallel with the inner surface and recessed away from the inner surface, the tongue having a length and a distal end, the distal end having a snap-off portion which can be removed to shorten the length, the channel and the tongue acting as a guide for a bolt of a door lock, mounting apertures disposed in the flat portion for mounting the strike housing on the inner surface, each mounting aperture being shaped and sized to receive from the outer surface an adjustment insert, each adjustment insert having a main body having an offset aperture for a mounting screw and an extension extending from the main body and each mounting aperture having a peripheral flange that receives the extension, each adjustment insert being shaped and sized to fit in a respective mounting aperture in a first position wherein the offset aperture and the strike housing are distally disposed or in a second position wherein the offset aperture and the strike housing are proximally disposed and the snap-off portion is removed from the tongue, and the main body rests against the flange in both the first position and the second position.

2. The face plate of claim 1 further comprising installation apertures disposed in the flat portion for installing the face plate to a door jamb.

* * * * *